US006431618B1

(12) United States Patent
Choo

(10) Patent No.: US 6,431,618 B1
(45) Date of Patent: Aug. 13, 2002

(54) LOCKING DEVICE OF TAILGATE FOR VEHICLE

(75) Inventor: Jin Su Choo, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/611,613

(22) Filed: Jul. 7, 2000

(30) Foreign Application Priority Data

Dec. 10, 1999 (KR) ..... 99-56722

(51) Int. Cl.[7] ..... E05C 3/06

(52) U.S. Cl. ..... 292/216; 292/DIG. 3; 292/DIG. 29

(58) Field of Search ..... 292/216, 169.14, 292/169.17, 48, DIG. 3, DIG. 23, DIG. 29, DIG. 43, DIG. 42, 201

(56) References Cited

U.S. PATENT DOCUMENTS 3,645,043 A * 2/1972 Velavicius et al. ..... 49/370
4,157,844 A * 6/1979 Sarosy et al. ..... 292/48
5,035,449 A * 7/1991 Shiratori et al. ..... 292/48
5,292,374 A * 3/1994 Bender et al. ..... 70/208
5,947,536 A * 9/1999 Mizuki et al. ..... 292/201
6,017,067 A * 1/2000 Yoneyama et al. ..... 292/216
6,186,215 B1 * 1/2001 Kodama et al. ..... 292/201

* cited by examiner

*Primary Examiner*—Paul N. Dickson
*Assistant Examiner*—Benjamin A Pezzlo
(74) *Attorney, Agent, or Firm*—Christie, Parker & Hale, LLP

(57) ABSTRACT

A locking device of tailgate for vehicle comprising a base plate having three mounting portions, a connecting flange and two limit flanges; a locking lever pivotally mounted on the base plate and connected with a key lock through a key locking rod and a tailgate latch through a tailgate latch locking rod respectively; an open lever pivotally mounted on the base plate and connected with a glass latch through a glass locking rod and a glass open handle, and being operated by the glass open handle; and the locking lever having a stopper for limiting the operation of the open lever, and the open lever having a stopper for limiting the operation of the locking lever.

11 Claims, 4 Drawing Sheets

LOCKING DEVICE OF TAILGATE FOR VEHICLE

FIELD OF THE INVENTION

The present invention relates to a locking device of tailgate for vehicle, more particularly to a locking device of tailgate for vehicle which can simultaneously control the locking of a tailgate latch and the locking of a glass latch.

BACKGROUND OF THE INVENTION

Generally, a locking device of a tailgate for vehicle locks or unlocks the tailgate latch according to the state that a key lock is locked or unlocked, and the tailgate latch is locked when the key lock is unlocked.

FIG. 5 is a schematic diagram of the state that the prior tailgate-locking device is mounted on a vehicle. The prior tailgate-locking device can unlock a tailgate latch 10 when a key lock 80 is unlocked, and the tailgate 99 can be opened by hand.

And when the key lock 80 is locked, the tailgate latch 10 is locked by the mechanical operation of the locking device mounted on a base plate 100 and the tailgate 99 cannot be unlocked.

Meanwhile, recently a vehicle has been produced where the glass 98 of the tailgate 99 can be opened. This vehicle requires that the glass 98 is not opened when the tailgate gate 99 is locked.

Generally the prior tailgate-locking device, however, can control only locking and unlocking of the tailgate latch 10 and cannot control the locking and unlocking of the glass 98.

Therefore, in a vehicle that the glass of the tailgate can be opened, the conventional tailgate-locking device cannot control the locking and unlocking of the glass in the tailgate.

SUMMARY OF THE INVENTION

The object of the present invention is to provide a locking device of tailgate for a vehicle, which can simultaneously control the locking of the tailgate latch and the locking of the glass latch:

The present invention comprises a base plate having three mounting portions, a connecting flange and two limit flanges; a locking lever pivotally mounted on the base plate and connected with a key lock through a key locking rod and a tailgate latch through a tailgate latch locking rod respectively; an open lever pivotally mounted on the base plate and connected with a glass latch through a glass locking rod and a glass open handle, and being operated by the glass open handle; and the locking lever having a stopper for limiting the operation of the open lever, and the open lever having a stopper for limiting the operation of the locking lever.

A protrusion portion is provided on the base plate on which the open lever is pivotally connected so as to reduce the friction force that is occurred when the open lever is pivoted.

A protrusion portion is also provided on the base plate on which the locking lever is pivotally connected so as to reduce the friction force that is occurred when the locking lever is pivoted.

The protrusion of the locking lever is contacted with the protrusion of the open lever, when the tailgate is unlocked so that the glass latch can be unlocked.

Therefore, the locking device in accordance with the present invention can simultaneously control the locking of the tailgate latch and the locking of the glass latch when locking the tailgate with the key lock.

BRIEF DESCRIPTION OF THE DRAWINGS

The above object and other advantages of th e present invention will become more apparent by describing in detail the preferred embodiment of the present invention with reference to the attached drawings in which.

DETAILED DESCRIPTION OF THE PRESENT INVENTION

Figure 1:
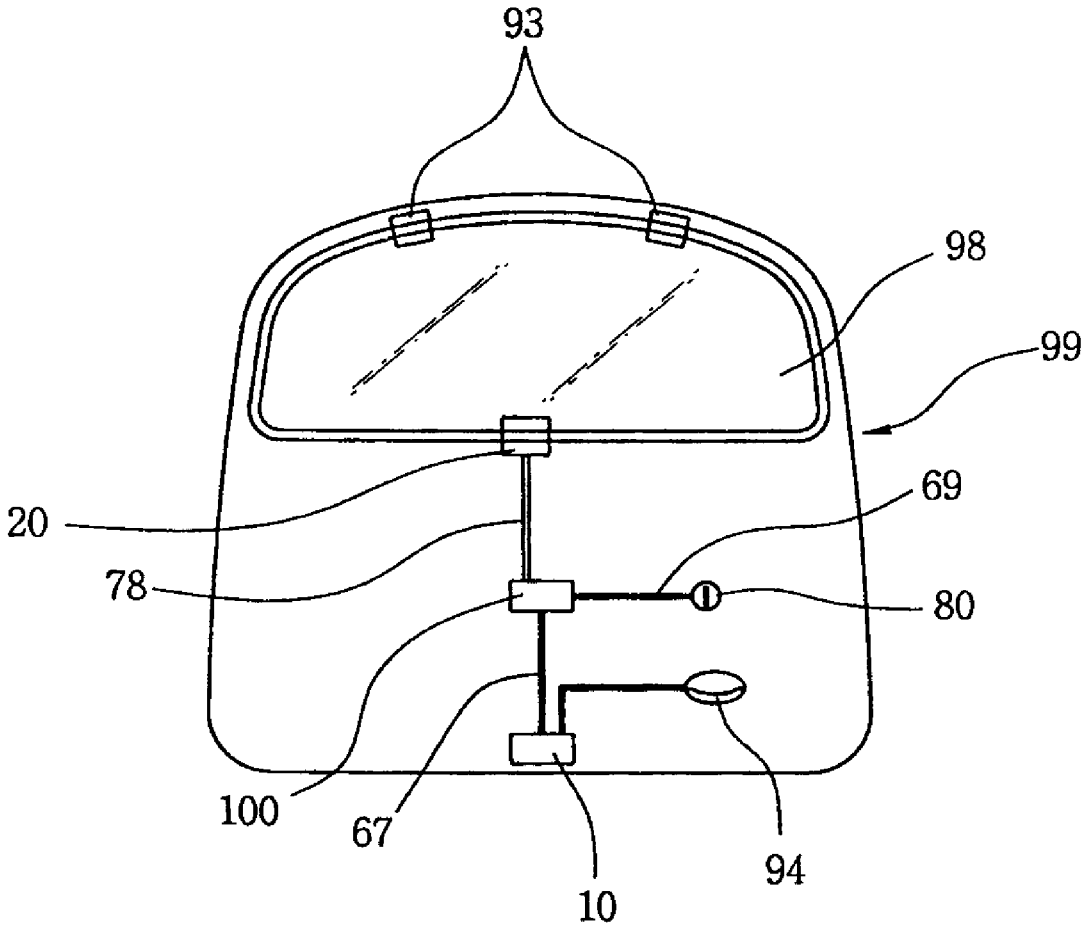
FIG. 1 is a schematic diagram of the state that the tailgate-locking device in accordance with the pre sent invention is mounted on vehicle.
Figure 2:
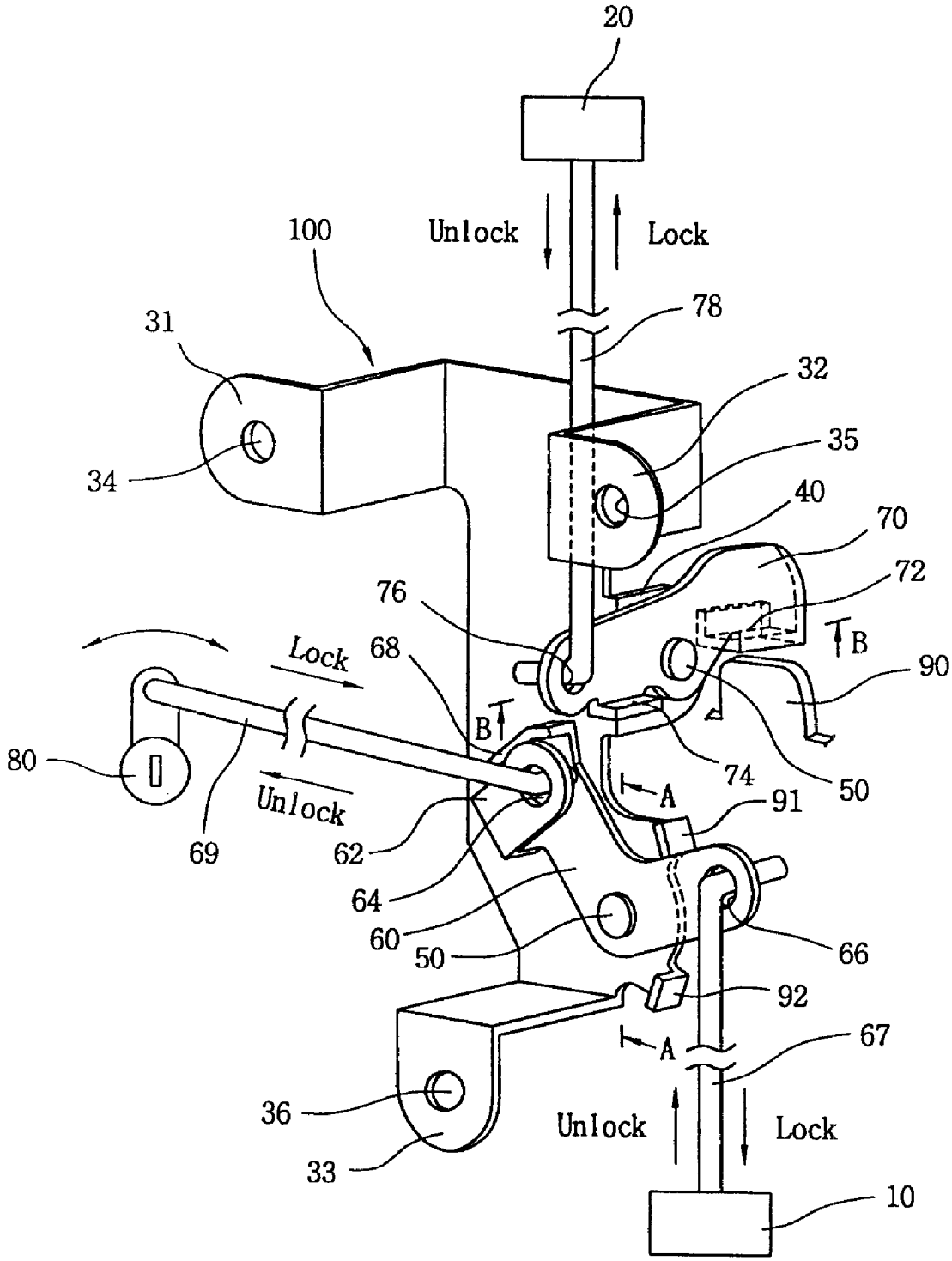
FIG. 2 is a perspective view of the tailgate-locking device in accordance with the present invention.
Figure 3:
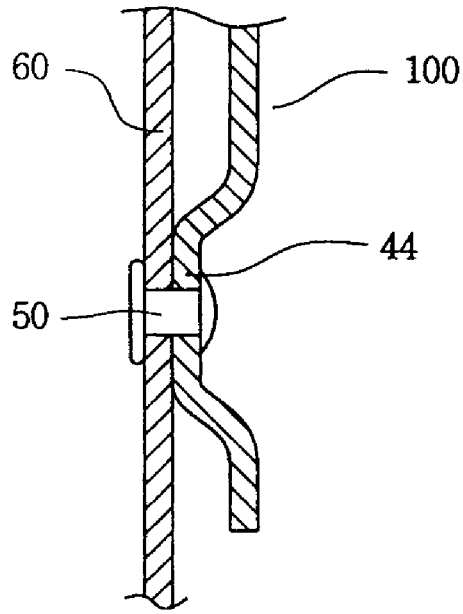
FIG. 3 is a cross section view taken along line A–A' in FIG. 2.
Figure 4:
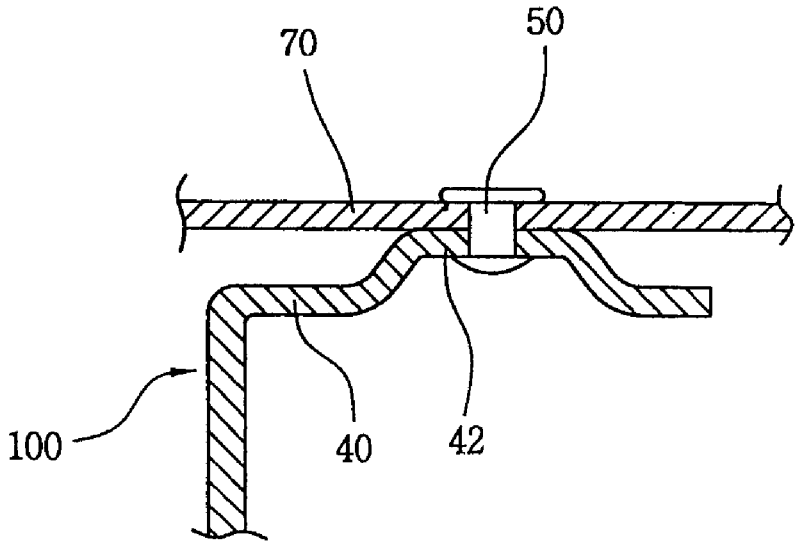
FIG. 4 is a cross section view taken along line B–B' in FIG. 2.
Figure 5:
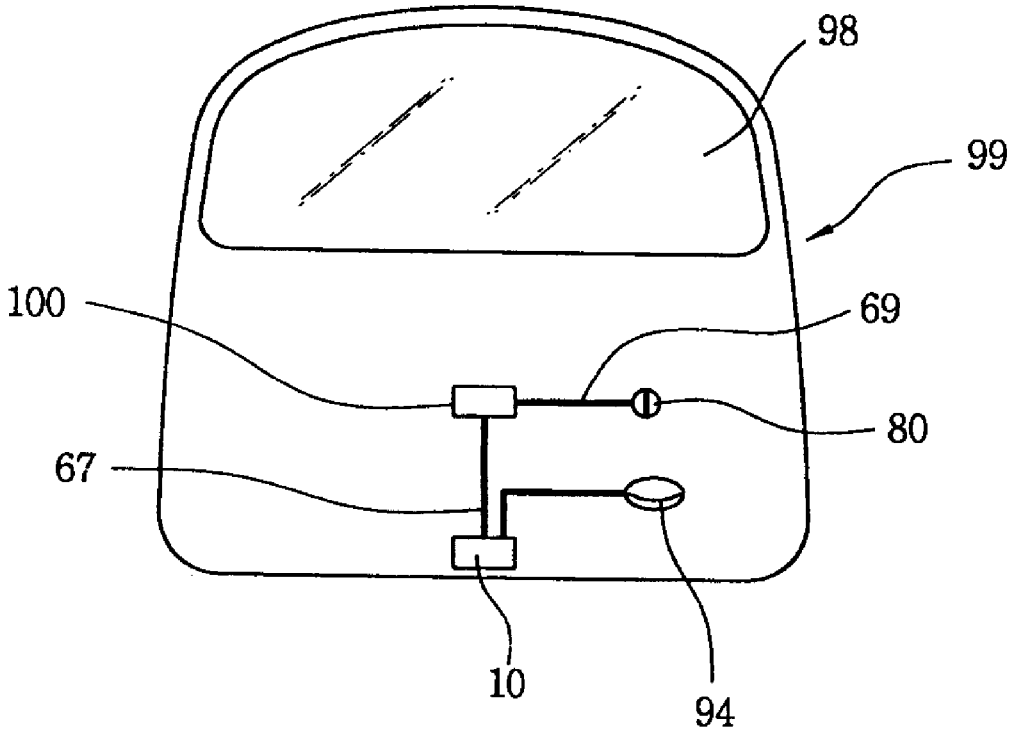
Fig. 5 (PRIOR ART)
FIG. 5 is a schematic diagram of the state that the prior tailgate-locking device is mounted on a vehicle

As shown in FIG. 2, the tailgate-locking device in accordance with the present invention comprises a base plate 100 on which a locking lever 60 and an open lever 70 are pivotally connected.

The locking lever 60 is pivotally connected with a tailgate-locking rod 67 and a key-locking rod 69 respectively, and the open lever 70 is pivotally connected with a glass latch 20 and a glass open handle 90 respectively.

The base plate 100 has three mounting portion 31,32,33, and is mounted on the tailgate 99 thorough screw holes 34,35,36 provided on the mounting portion 31,32,33.

A connecting flange 40 is provided in the middle portion of the base plate 100, and two limit flanges 91,92 for controlling the operating range of the locking lever 60 are provided in the base plate 100.

The open lever 70 which locks and unlocks the glass latch 20 according to the operation of the glass open handle 90 is pivotally connected with the connecting flange 40 through a pin 50, and a t protrusion portion 42 is provided on the connecting portion of the base plate 100 on which the open lever 70 is pivotally connected by the pin 50 so as to reduce the friction force when the open lever 70 is pivoted.

A glass locking rod 78 is connected to an aperture 76 provided on an end of the open lever 70 that is connected with the glass latch 20, and the glass open handle 90 is connected with a supporting flange 72 provided on an end of the open lever 70.

A stopper 74 is provided on the lower portion of the open lever 70 for limiting the operation of the locking lever 60, when the tailgate latch 10 is locked.

The locking lever 60 is pivotally connected with the lower portion of the base plate 100 through the pin 50, and a protrusion portion 44 is provided on the connection portion of the base plate 100 on which the locking lever 60 is pivotally connected by the pin 50 so as to reduce the friction force when the locking lever 60 is pivoted.

And a stopper 68 is provided on the upper portion of the locking lever 60 for limiting the operation of the open lever 70, when the glass latch 20 is unlocked.

In the locking device of tailgate for vehicle in accordance with the present invention, the tailgate 99 can be unlocked with the tailgate latch 10 is unlocked by using the key lock 80, and the glass latch 20 can be unlocked when the open lever 70 is pivoted by using the operation of the open handle 90. The glass 98 can be pivoted and opened around a hinge 93.

On the other hand, when the tailgate latch 10 is locked by using the key lock 80, the tailgate 99 cannot be opened and the stopper 68 provided on the upper portion of the locking lever 60 is contacted with the stopper 74 provided on the upper portion of the open lever 70. Therefore, the open lever 70 is locked and the glass latch 20 cannot be unlocked.

As a result of that, when the tailgate 10 is locked by using the key lock 80, the open lever 70 cannot be pivoted and the unlocking operation of the glass latch 20 is limited. Thus, the tailgate 99 and the glass 98 can be unlocked and locked by the key lock 80.

As described above, the locking device of tailgate for vehicle in accordance with the present invention can simultaneously control the locking of the tailgate latch and the locking of the glass latch by locking the tailgate with the key lock.

What is claimed is:

1. A locking device of tailgate of vehicle comprising:

a base plate;

a locking lever pivotally mounted on the base plate and connected with a lock through a locking rod and with a tailgate latch through a tailgate latch locking rod respectively;

an open lever pivotally mounted on the base plate and connected with a glass locking latch through a third locking rod and a handle for opening the glass, and being operated by the handle; and the locking lever having a stopper for limiting rotation of the open lever, and the open lever having a stopper for limiting rotation of the locking lever.

2. A locking device according to claim 1, wherein a protrusion portion is provided on the base plate and wherein the open lever is pivotally connected to the protrusion so as to reduce friction between the open lever and the base plate.

3. A locking device according to claim 1, wherein a protrusion portion is provided on the base plate and wherein the locking lever is pivotally connected to the protrusion so as to reduce friction between the locking lever and the base plate.

4. A locking device according to claim 1 wherein the base plate comprises two flanges for limiting rotation of the locking lever relative to the base plate.

5. A locking device according to claim 1 wherein the base plate further comprises a flange, wherein the open lever is pivotally connected to the flange.

6. A locking device according to claim 5 wherein the base plate comprises a second flange and a third flange for limiting rotation of the locking lever relative to the base plate.

7. A locking device according claim 1 wherein the open lever rotates between a first position for locking a glass with the glass locking latch and a second position for unlocking the glass with the glass locking latch, wherein the locking lever rotates between a first position for locking the tailgate latch and a second position for unlocking the tailgate latch, wherein when the locking lever is in the first locking lever position, the stopper on the locking lever prevents rotation of the open lever to the open lever second position.

8. A locking device according claim 7, wherein when the open lever is in the open lever second position, the stopper on the open lever prevents rotation of the locking lever to the locking lever first position.

9. A locking device according claim 1 wherein the open lever rotates between a first position for locking a glass with the glass locking latch and a second position for unlocking the glass with the glass locking latch, wherein the locking lever rotates between a first position for locking the tailgate latch and a second position for unlocking the tailgate latch, wherein when the open lever is in the open lever second position, the stopper on the open lever prevents rotation of the locking lever to the locking lever first position.

10. A locking device according to claim 1 wherein the locking lever stopper is a flange extending from the locking lever.

11. A locking device according to claim 1 wherein the open lever stopper is a flange extending from the open lever.

* * * * *